United States Patent [19]

Nock

[11] Patent Number: 4,773,539

[45] Date of Patent: Sep. 27, 1988

[54] DISPLAY CARTON FOR ELECTRIC LAMP

[75] Inventor: John M. Nock, Rockport, Mass.

[73] Assignee: GTE Products Corporation, Danvers, Mass.

[21] Appl. No.: 142,329

[22] Filed: Jan. 4, 1988

Related U.S. Application Data

[63] Continuation of Ser. No. 919,953, Oct. 17, 1986, abandoned.

[51] Int. Cl.[4] ..... B65D 85/42

[52] U.S. Cl. ..... 206/418; 206/45.14; 229/41 C

[58] Field of Search ..... 206/45.14, 418, 419, 206/420, 421, 428, 521.2, 521.7; 229/109, 161, 41 C

[56] References Cited

U.S. PATENT DOCUMENTS

| | | | |
|---|---|---|---|
| 1,944,214 | 1/1934 | Bueschel | 206/521.7 |
| 2,321,473 | 6/1943 | Ferguson | 229/161 |
| 2,946,498 | 7/1960 | Williamson | 206/419 |
| 3,282,410 | 11/1966 | Cote | 206/418 |
| 3,337,033 | 8/1967 | Cote | 206/418 |
| 3,355,011 | 11/1967 | Cilluffo | 206/419 |
| 3,526,352 | 9/1970 | Swett | 229/39 |
| 3,712,461 | 1/1973 | Schillinger | 206/45.14 |
| 3,734,397 | 5/1973 | Cote | 206/418 |
| 3,750,934 | 8/1973 | Clinage | 229/41 C |
| 4,134,531 | 1/1979 | Martinez et al. | 229/23 BT |
| 4,162,008 | 7/1979 | McCalmont | 206/45.14 |
| 4,561,542 | 12/1985 | Przepiora et al. | 206/418 |
| 4,582,199 | 4/1986 | Schuster | 206/428 |
| 4,717,022 | 1/1988 | Combs | 206/418 |

FOREIGN PATENT DOCUMENTS

| | | | |
|---|---|---|---|
| 102898 | 10/1965 | Denmark | 206/419 |
| 140388 | 5/1953 | Switzerland | 206/419 |

*Primary Examiner*—David T. Fidei

*Attorney, Agent, or Firm*—Lawrence R. Fraley

[57] ABSTRACT

A display carton for an electric lamp or similar fragile article which is formed of a single sheet of paperboard material and designed for securedly retaining the lamp therein through use of a compressive force on the lamp. This force is applied by a depressible, resilient platform formed by the carton's two inwardly bent and connected panel members against two opposingly located, rigid tab members which engage an upper, outer surface of the lamp's bulbous, glass envelope.

11 Claims, 6 Drawing Sheets

DISPLAY CARTON FOR ELECTRIC LAMP

This application is a continuation of application Ser. No. 919,953, filed Oct. 17, 1986, now abandoned.

TECHNICAL FIELD

This invention relates to display cartons and particularly to such cartons for packaging fragile articles such as electric lamps which include a bulbous envelope portion and a protruding end (neck) portion (e.g., containing thereon a base).

BACKGROUND

Protection of fragile articles such as electric lamps having bulbous glass envelopes from breakage during shipping, storage and eventual display and handling at the retail store level is usually accomplished by placing the lamp in a suitable wrapper or carton at the lamp factory. The lamp typically remains in this carton until final sale to a purchaser at the retail store who eventually removes it for placement in an appropriate receptacle (socket). In view of the relatively delicate nature of these glass articles, such protection is absolutley essential. Understandably, in view of the large numbers of such products produced and sold annually in this country and throughout the world, the cost for providing such effective protection constitutes a significant factor in the lighting industry. Examples of efforts to provide reduced cost packages are illustrated in the following U.S. Pat. Nos.

3,526,352—Swett
3,734,397—Cote
3,750,934—Clinage
4,134,531—Martinez et al
4,561,542—Przepiora et al In U.S. Pat. No. 3,526,352, there is shown a dispensing-type carton of octagonal configuration having flap elements which appear to provide a snap-action, self-locking end closure for the carton. This carton is designed especially for delicate food products such as potato chips. In U.S. Pat. No. 3,750,934, there is shown a fiberboard container having a hexagonal configuration including a series of inwardly turned, upwardly angled and apparently rigid panels formed from parts of the container's walls. These panels apparently provide some means of rigidifying the container to support the article (e.g., a light bulb) positioned therein. In U.S. Pat. No. 3,734,397, there is shown a carton of square cross-section for containing a parabolic reflector light bulb, the carton including a pair of yoke-like platforms formed by inwardly turned, upwardly angled and apparently rigid panels or flaps cut from the carton's walls for supporting the positioned bulb. These panels are also spaced apart so as to only engage opposite surfaces of the lamp's curved neck. In U.S. Pat. No. 4,134,531, the paperboard container (for cheese products) includes a tubular body portion of octagonal configuration which is apparently self-locking. Lastly, in U.S. Pat. No. 4,561,542, there is illustrated a carton of hexagonal configuration wherein panels cut from the carton's sides combined to form a platform wherein the contained article (light bulb) is frictionally retained.

Many of the above cartons, although considered of relatively firm and rigid construction capable of satisfactorily retaining the contained article(s), are deemed to be of such relatively complex construction that they are not considered readily adaptable to mass production techniques to assure a cost efficient end product. And those which are deemed more readily adaptable to such production (e.g., automatic loading and locking) are not considered satisfactory from the standpoint of effective product containment (e.g., preventing rotational or other undesirable product movement).

It is believed, therefore, that a display carton for an electric lamp or similar fragile article which provides sound article containment on a cost-effective basis such that the combined carton and contained article product can be readily produced on a mass production basis would constitute a significant advancement in the art.

DISCLOSURE OF THE INVENTION

It is, therefore, a primary object of this invention to enhance the packaging art by providing a display carton for an electric lamp or similar fragile article which provides for effective product containment and display, and which can be produced on a cost effective, mass production basis.

It is another object of the present invention to provide such a carton which conserves packaging material (paperboard) while providing effective product containment in an attractive manner of display toward prospective purchasers of the end product.

These and other objects are accomplished in accordance with one aspect of the invention by the provision of a display carton for an electric lamp or similar article wherein the carton includes a paperboard member having a plurality of hinged side walls which define opposing open ends therein, a pair of panel members which are each secured to or form part of a respective one of the side walls and are bent inwardly, leaving openings in the side walls which serve as display windows for the contained article, and a pair of tab members which are each secured to or form part of a respective one of the side walls and which also extend inwardly to engage a surface of the positioned article. Each of the panel members includes an aperture therein which become aligned when the panel members are so inwardly bent so as to provide a common aperture for having the article's protruding end portion inserted therein. These panel members also serve to provide a downwardly depressed resilient platform which exerts an upward force against the contained article when the end portion thereof is positioned within the common aperture to force the article upwardly against the tab members. The carton thus exerts a compressive force on the article to securedly retain it therein.

In one example, each of the panel members is secured to or forms part of the same side wall as a respective one of the tab members, the resulting two side walls being located opposite each other in an eight-sided (octagonal) arrangement.

BEST MODE FOR CARRYING OUT THE INVENTION

For a better understanding of the present invention, together with other and further objects advantages, and capabilities thereof, reference is made to the following disclosure and appended claims in connection with the above-described drawings.

Although the invention will be described with regard to the containment of an electric lamp having a glass envelope, it is understood that the teachings of this invention are also applicable to containment of similarly shaped fragile articles having an enlarged body or bulbous portion and a protruding end portion such as illustrated herein.

Figure 1:
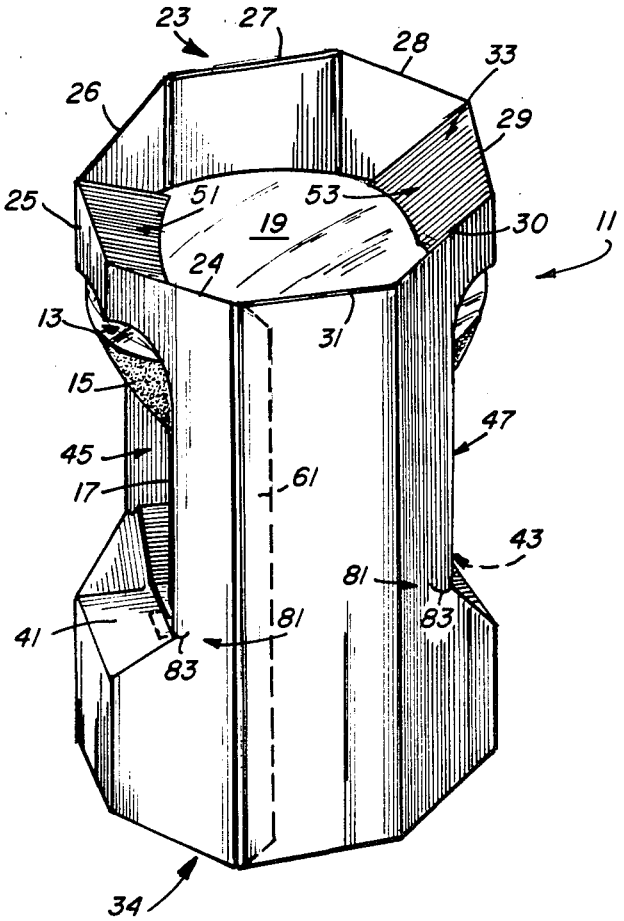
FIG. 1 is a perspective view of a display carton in accordance with a preferred embodiment of the invention.
Figure 6:
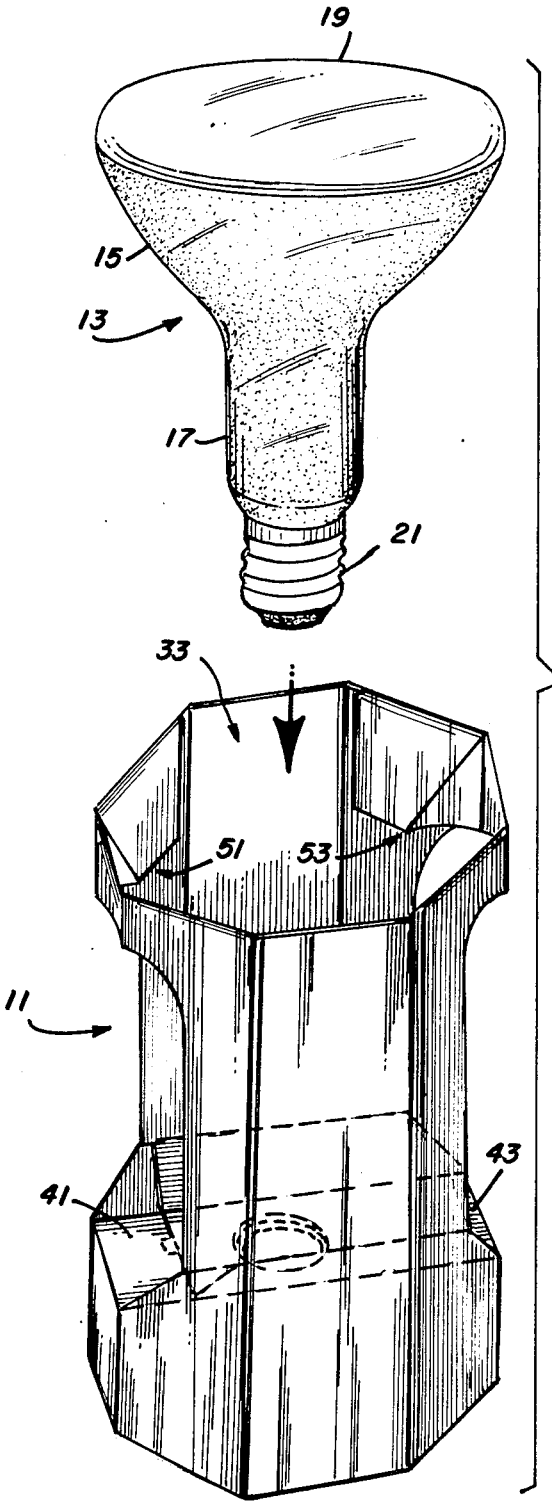
Figure 7:
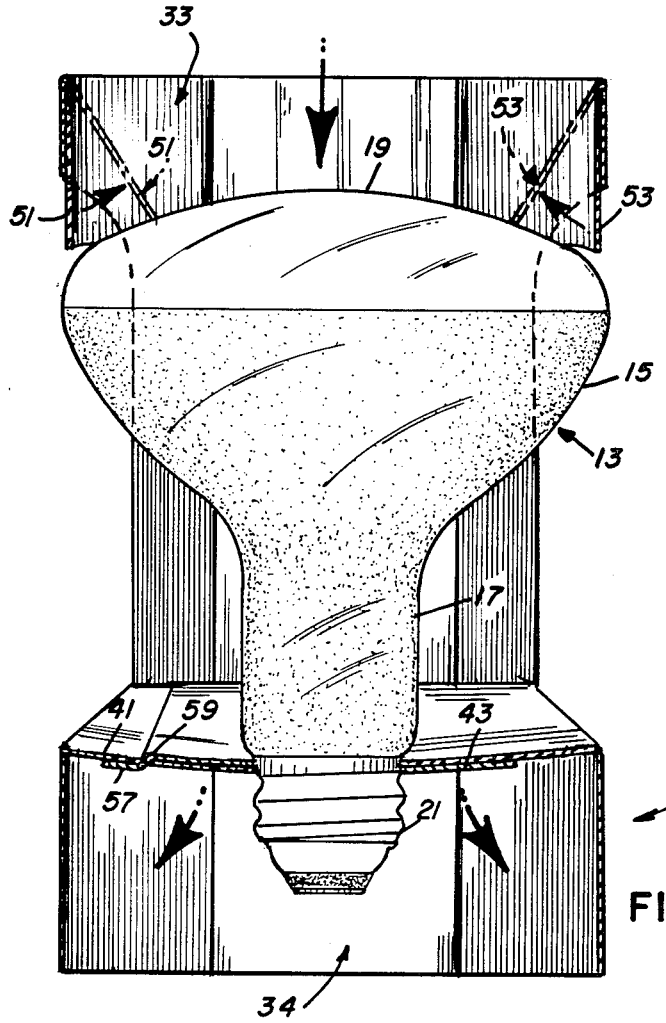

With particular attention to FIG. 1, there is shown a display carton 11 for an electric lamp or similar fragile article 13 in accordance with a preferred embodiment of the invention. As described herein, carton 11 is designed for securedly containing therein articles having a bulbous portion 15 and a protruding end portion 17 (FIGS. 6, 7). One particular example of such an article, as illustrated and described herein, is a 75-watt PAR (parabolic aluminized reflector) flood lamp produced and sold by the assignee of the instant invention and particularly adapted for downlighting or similar applications. As stated, however, display carton 11 is fully capable of containing therein articles other than the aforementioned reflector flood lamp, including, for example, standard incandescent lamps of the 40, 60, 75, 100 and 150-watt category typically utilized in many of today's homes.

In the example described herein, the bulbous portion 15 of the lamp is reflectorized and terminates in a rounded face portion 19. Lamp 13 further includes an extended neck portion terminating in a metallic base 21, which neck and base portions represent the protruding end portion of this product. See especially FIGS. 6 and 7.

Carton 11, as will be described herein, is particularly adapted for positively containing lamp 13 therein while enabling the perspective customer to view the lamp. By positive containment is meant effective securement of the relatively fragile article to prevent unnecessary and possibly harmful movement (e.g., rotational) thereof within the carton. As will be explained, this positive containment is made possible through the exertion of a relatively strong compressive force on the lamp from opposing directions. This is accomplished by a carton of compact, attractive design which can be economically produced on a mass production basis.

As shown in FIG. 1, carton 11 comprises a paperboard member 23 having a plurality (e.g., eight) of longitudinal side walls 24, 25, 26, 27, 28, 29, 30 and 31 which define a pair of opposing open end portions 33 and 34 (see especially FIG. 7). By the term paperboard is meant boxboard packaging material, examples of which are known in the art. In a preferred example, solid bleached sulfate was utilized and has proven very satisfactory. This material is deemed sufficiently rigid for the purposes defined herein, including particularly the ability to be readily folded after scoring thereof and to exert the aforementioned force on lamp 13. In a preferred embodiment, the paperboard member was produced from a single sheet of material, thereby substantially reducing manufacturing costs thereof.

As shown in FIG. 1, the side walls are hingedly connected to one another to thus define a tubular, octagonal member having an inner diameter substantially similar in dimension to the outer diameter of the bulbous, glass envelope of lamp 13.

Carton 11 further includes a pair of panel members 41 and 43 (see especially FIGS. 5 and 7) which are each secured to or form part of a respective one of the paperboard member's side walls and are bent inwardly toward the interior of the tubular, octagonal member, leaving openings 45 and 47, respectively, in the respective side walls. These openings, as indicated, serve as display windows for the contained lamp 13. Preferably, each panel member is cut from one or more of the respective side walls and initially bent inwardly at an approximate 90 degree angle relative thereto. As will be defined herein, these two panel members serve to form a resilient platform capable of exerting a positive upward force against the lamp when the lamp is positioned in the paperboard member. Accordingly, carton 11 further includes a pair of tab members 51 and 53 which are each also secured to or form part of a respective one or more of the paperboard member's side walls and which extend inwardly toward the interior of the octagonal, tubular paperboard member to engage the outer, rounded surface of face portion 19 of lamp 13. This engagement locks the lamp within carton 11 and, when combined with the aforementioned engagement by the resilient platform formed by panel members 41 and 43, results in a compressive force being exerted on lamp 13 to thus securedly retain it without unnecessary and undesirable movement thereof. This formed platform, as defined, is resilient so as to enable the lamp to be overdriven into carton 11 during loading to cause the platform to be downwardly depressed to the extent illustrated in FIG. 7 such that the tendency thereof to return to its original, normal orientation will result in the aforedefined upward force against the lamp's protruding end portion. Of added significance, this foldable panel arrangement, which results in formation of the resilient platform, is fabricated from portions of the paperboard member's side walls that are so cut, scored and interconnected that these panels automatically "snap" into the desired platform configuration as the carton reaches its fully expanded, erect position immediately prior to receiving lamp 13. The resilient platform thus also functions to lock the carton in its tubular, octagonal configuration at the respective lower portion thereof. Of added significance, the resulting platform is located sufficiently inward from the lower open end 34 of the carton to insure that the base 21 of the lamp is sufficiently recessed and thus protected from possible damage thereto.

In the aforementioned example wherein a 75-watt PAR flood lamp was contained, carton 11 possessed an overall length (height) of about 5.88 inches and an internal diameter (distance between opposing side walls) of about 3.75 inches. The contained lamp possessed an overall length of about 4.50 inches and the bulbous, glass envelope portion 15 thereof contained an outer diameter of about 3.75 inches, this latter dimension thus being substantially the same as the internal diameter of carton 11.

Figure 2:
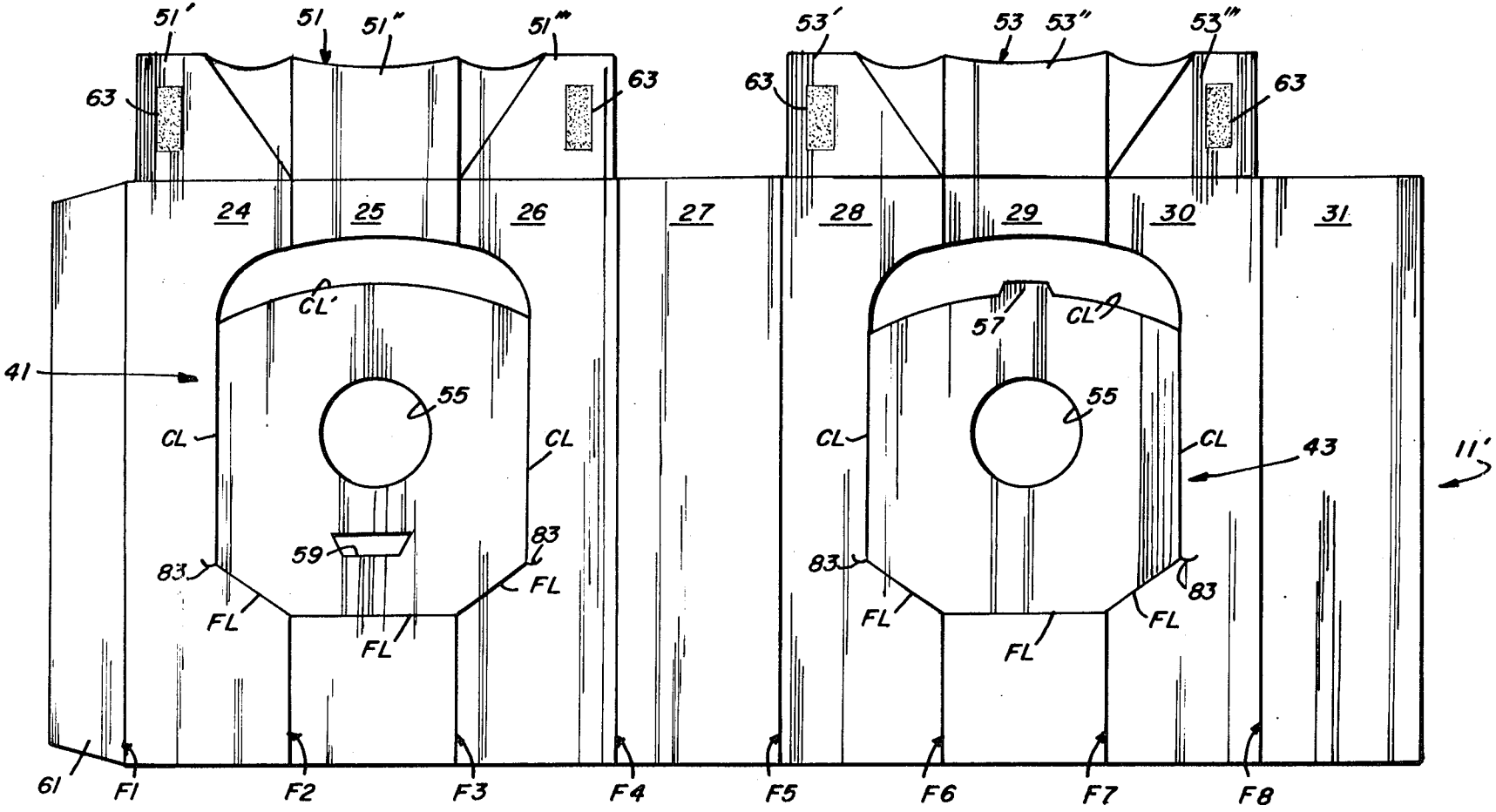
FIGS. 2–7 illustrate the various steps in producing the display carton illustrated in FIG. 1.
Figure 3:
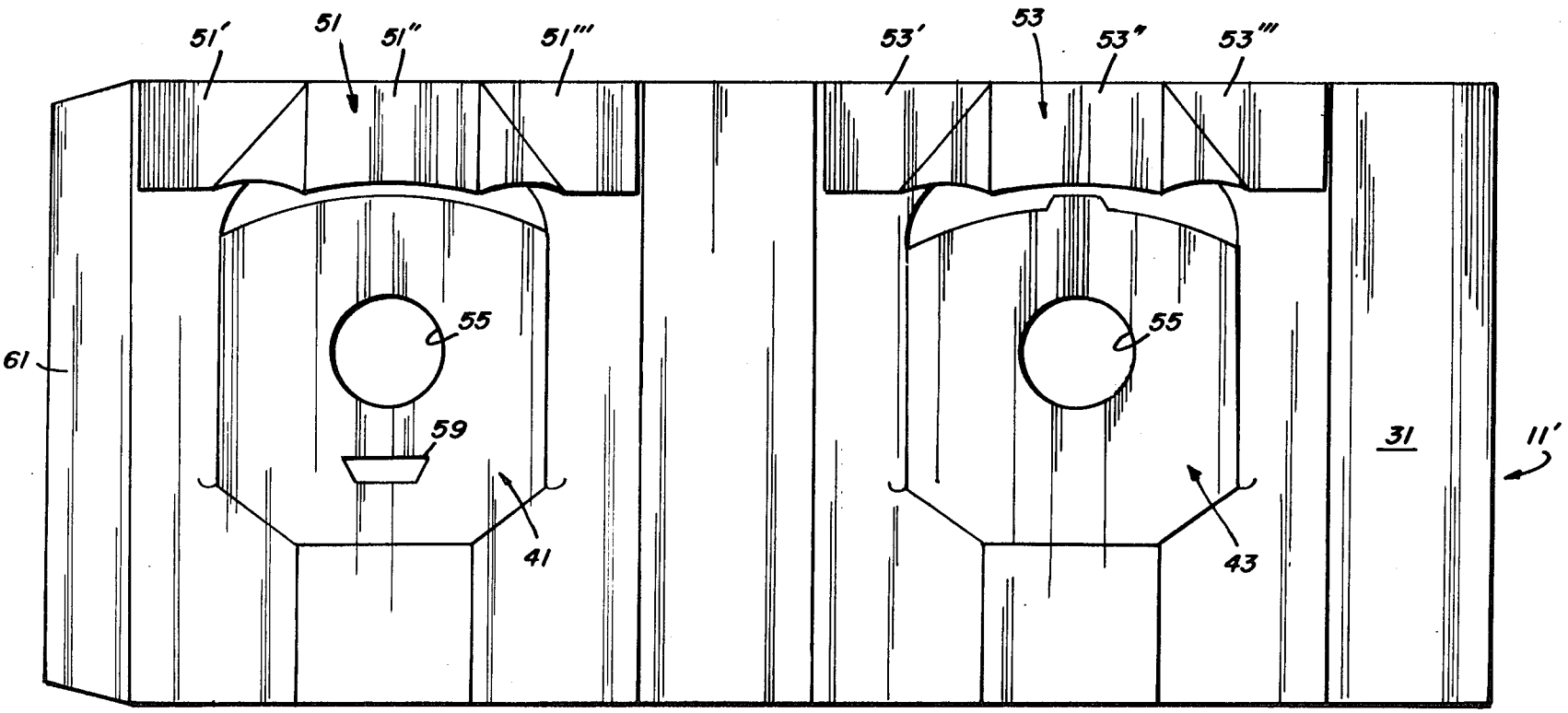

In FIGS. 2–7, there is illustrated the preferred method of assembling carton 11, also including positioning of electric lamp 13 therein. In FIG. 3, there is shown a blank 11' which, as illustrated, is from a single sheet of paperboard material, such as the aforementioned solid bleached sulfate. Alternative materials for blank 11' include machine clay-coated newsboard, chip board, kraft (coated or uncoated), and bleached manilla. In one example, blank 11', of substantially rectangular configuration, possessed an overall length of about 13 inches and an overall height (including tab members) of about 7 inches. Blank 11' has been printed (not shown) with the appropriate identifying markings, logos, etc. and, as shown, has been cut and scored in the desired pattern. Specifically, blank 11' has been die-cut, resulting in the formtion of eight longitudinal fold lines F1-F8 to thus define the above-identified side walls 24-31, respectively. Fold lines F1-F8 are otherwise defined as standard crease fold lines. Additionally, blank 11' includes the two above-identified tab members 51 and 53, each comprised of three tab segments (51', 51'' and 51''' for tab 51 and 53', 53'' and 53''' for tab 53), each of these segments representing an extension of a respective side wall as indicated. It is understood, however, that in the broadest sense, each of the lamp-engaging tabs 51 or 53 may be secured to or form part of only one of the side walls of blank 11'. Preferably, however, each tab member includes the identified three individual segments which in turn extend from (and thus form part of) a singular respective side wall.

Blank 11' is also shown in FIG. 2 as including the above-identified panel members 41 and 43 cut therein. As shown, each panel is formed from one full side wall (i.e., side wall 25 for panel 41) and portions of adjacent side walls to this main side wall. Each panel is defined by vertical cut lines CL and a substantially horizontal, upper curvilinear cut line CL'. The lower portion of each panel is defined by three linear, angled fold lines FL. Still further, each panel is provided with a singular aperture 55 which, in the above example, possessed a diameter of about 1.06 inch. Each aperture 55 is also cut substantially in the center section of the three section panel. As in the case of the above-identified tab members, each panel, in the broadest sense of the invention may be formed from a singular side wall. Preferably, however, a multiple-sectioned panel configuration as illustrated and defined herein is utilized. Further, each tab member (i.e., tab 51) is formed from the same side wall(s) as a respective one of the panel members (i.e., panel 41), as shown in FIGS. 2 and 3. Thus, in the final embodiment, the two tab members and corresponding panel members will be oppositely oriented (see especially FIG. 7) to receive and engage lamp 13.

In addition to aperture 55, panel member 43 is also shown in FIG. 2 as including a protruding tab segment 57 which, in final assembly, is designed for aligning with and being slidably positioned within a slot 59 formed within opposite panel 41. This connection is best shown in the cross-sectional view in FIG. 7.

Blank 11' also includes an outer glue panel 61 which is designed for being glued to a part of the opposing, outermost side wall 31 when blank 11' is folded into the final, octagonal configuration. Further, each of the above-identified tab members is shown in FIG. 2 to include a pair of glue locations 63 within the outer segments thereof. Glue locations 63 represent the referred locations for application of the desired glue for securing each tab's outer sections to the corresponding side wall in the manner shown in FIG. 3. Alternatively, these glue locations may be provided on the respective side wall substantially adjacent the locations indicated in FIG. 2 (i.e., upper portion of side walls 24 and 26).

In FIG. 3, each of the tab members has been folded over and secured in the manner indicated. As stated, each of the outer segments of each tab is thus affixed to a respective side wall with the innermost segment not being glued to its side wall counterpart. As shown in FIG. 3, the lowermost edge of each tab member substantially aligns with the uppermost edge of the corresponding panel member to thus substantially cover the openings illustrated in FIG. 2 adjacent the panel members. This represents a significant feature of the invention, as will be further described below, because it enables the respective tab members to be activated (e.g., engaged) by the carton-forming machinery through these openings, which are increased substantially as a result of the inward bending of the respective panel members (also described below).

The preferred glue for securing the tab members in the manner shown is a hot melt glue of a type known in the art. This glue is preferred in view of its relatively instantaneous securing ability. Alternatively, a cold adhesive of the type known in the art could be utilized, provided an adequate drying time (e.g., approximately two minutes) is allowed.

Figure 4:
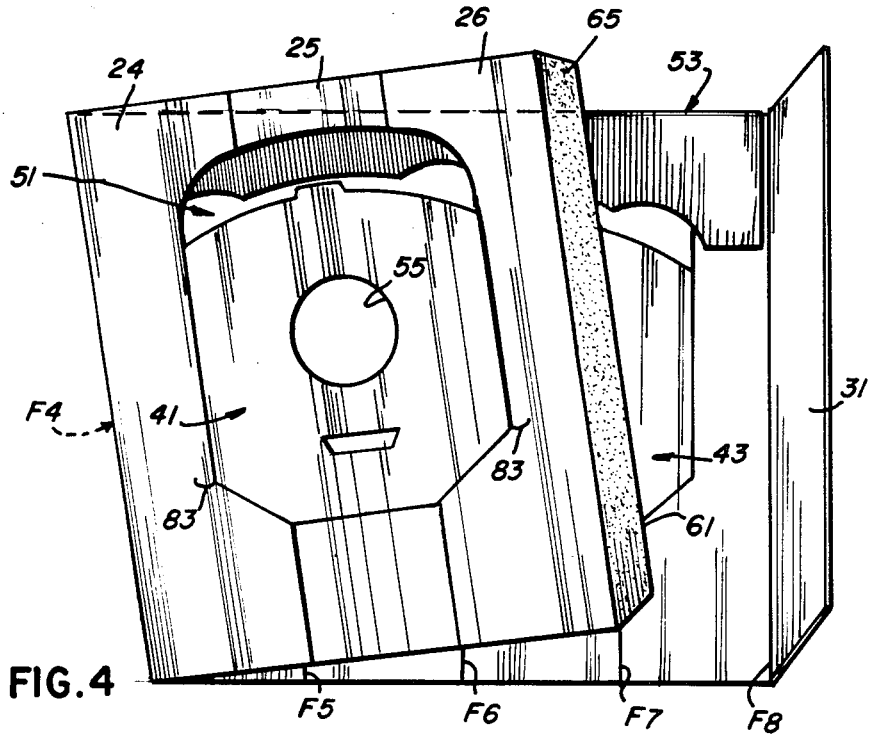
Figure 5:
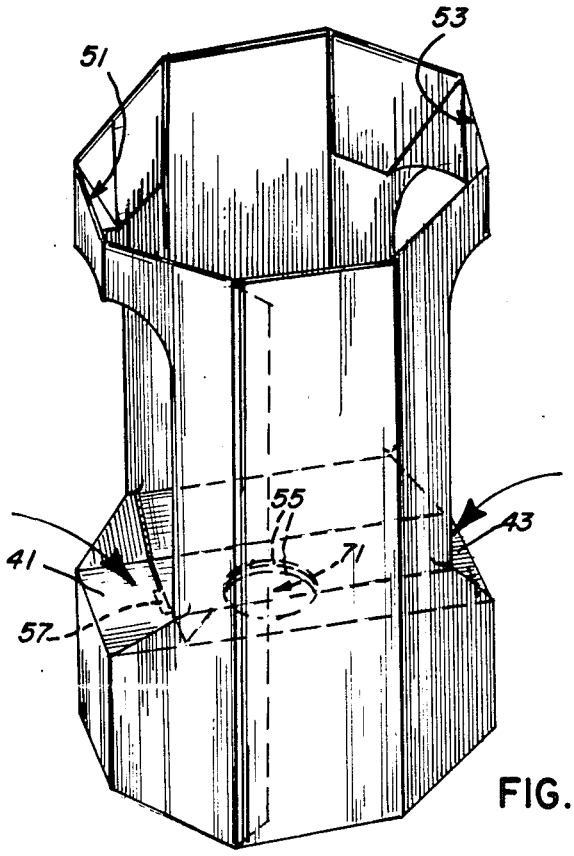

With tab members 51 nd 53 secured in place at the described outer portions thereof, blank 11' is folded along fold line F4 in the manner depicted in FIG. 4. Subsequently, outermost side wall 31 is folded along fold line F8 such that it will engage the outermost, glued surface 65 of glue panel 61. Accordingly, a substantially flat member is produced which, if desired, can be stacked with several other such members for shipping (e.g., to the lamp factory for lamp loading). Blank 11' is then expanded (opened) to the desired octagonal configuration shown in FIG. 5. In doing so, each of the described panel members 41 and 43 are simultaneously bent inwardly toward the interior of the expanded carton blank. Tab members 51 and 53, not yet activated, are substantially flush with the paperboard member's side walls (FIG. 5). As shown, panel 41 is the first of the two panels to be fully bent inwardly (at an angle of about 90 degrees to the respective side walls) afterwhich panel member 43 is bent inwardly to lie atop panel 41. This results in formation of a joint connection between the two panel members when the protruding tab segment 57 is inserted within the corresponding slot 59 in panel 41. This connection is of the snap-action type caused by the relative stiffness of the paperboard material for blank 11' and the resulting hinged (folded) and cut configuration of each panel from the respective side walls. As shown in FIG. 5, each of the apertures 55 within the respective panel members align to define a common aperture 71 which is designed to accommodate the protruding end portion 17 of lamp 13. Most significantly, however, is the fact that the aligned and connected inwardly bent panel members, while serving to rigidify the carton at this location, also provide a substantially resilient platform capable of being downwardly depressed (FIG. 7) upon insertion of lamp 13 and engagement therewith by the lamp's protruding end portion. This represents a significant feature of the invention in that the resilient though rigid platform, while bearing the weight of the lamp, is capable of exerting an upward, continuous force against the lamp once the opposing ends of the lamp have been engaged by tab members 51 and 53. Thus the lamp can be overdriven into the expanded carton blank during lamp positioning (either automatically or manually) without harm to the paperboard material. Understandably, this unique feature greatly facilitates the lamp loading operation.

In FIG. 6, lamp 13 is shown in the initial stages of being inserted within the upper open end 33 of the expanded carton 11 whereupon it will be overdriven, as illustrated in FIG. 7, to cause the downward deflection of the slidably connected panel members 41 and 43. It is noted in FIGS. 6 and 7 that during this insertion, the secured tab members are substantially flat and thus lie flush against the respective hinged side walls. Understandably, this also facilitates lamp loading. With the resilient platform depressed by the downwardly forced lamp 13, both of the tab members 51 and 53 are engaged and forced inwardly to the location illustrated in phantom in FIG. 7, whereupon each will engage the respective outer surface 19 of lamp 13. Each tab is engaged by a component (e.g., arm) of the lamp-loading apparatus (not shown) and, because of its shape and mode of attachment to the respective side walls, "snaps" into the lamp-engaging position (phantom) in FIG. 7. It must be noted that when activation of tab members 51 and 53 occurs, lamp 13 has been overdriven to the extent that the tabs do not immediately engage the lamp's upper surface. Instead, a small spacing is left between each fully engaged tab and this surface, thus facilitating the aforementioned "snap" action. Subsequent release of lamp 13 by the lamp-loading apparatus allows it to move upward the distance of said spacing whereupon it contacts the inwardly oriented tabs. Accordingly, a compressive force is now exerted on the lamp to retain it within carton 11 in a substantially non-movable manner and yet one wherein the lamp is not damaged. Significantly, each of the tab members is activated through the respective opening formed within the side walls of carton 11 relative to panel members 41 and 43. As also shown in FIG. 7, each of these panel members, when inwardly bent in the manner defined, leaves an opening within the carton which subsequently serves as a window to display a substantial portion of lamp 13 to the prospective purchaser. In addition, the forward portion of the lamp's envelope can also be seen through the upper open end 33.

With regard the present invention, it is also understood that the protruding end portion 17 of lamp 13 is not frictionally positioned within the common aperture 71 defined by connected panel members 41 and 43. This end portion is thus loosely positioned therein, even further facilitating the lamp loading operation. It is of course within the scope of the invention to provide such frictional engagement (e.g., through provision of inwardly angled "tooth" segments or the like about the periphery of the respective apertures 55 such that the internal diameter thereof is less than that of the corresponding outer diameter of base 21) even though not necessary for lamp containment.

Figure 8:
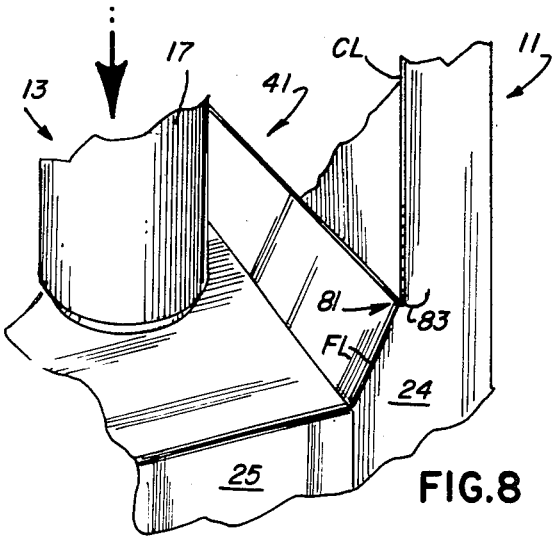
FIGS. 8 and 9 illustrate the preferred means of the invention for allowing the contained article to be overdriven into the paperboard container such that deflection (downward depression) of the resilient platform formed by the invention's panel members will occur, thus assuring the aforementioned compressive force on the article.
Figure 9:
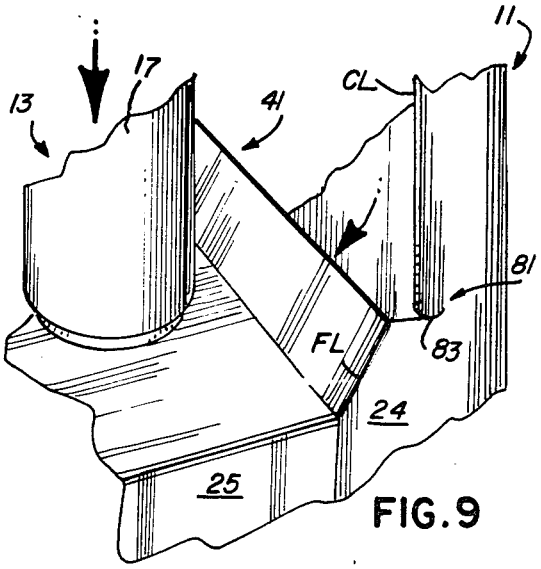

In FIGS. 8 and 9, there is illustrated the preferred means 81 for enabling the aforedefined depression of the connected panel members 41 and 43 such that the depression will not tear or similarly damage the paperboard member of carton 11. Although only a singular means 81 is shown in FIGS. 8 and 9, two such means are provided for each of the panel members (i.e., see FIG. 2). Specifically, means 81 includes a J-shaped cut 83 within the respective side wall (i.e., side wall 24 in FIG. 1) at the location of juncture of the cut line CL and fold FL each side of the panel. Thus, a total of four J-shaped cuts 83 are provided for carton 11, two for each panel. As shown in FIGS. 8 and 9, overdriving lamp 13 causes the respective panel members (only panel member 41 shown) to be downwardly depressed substantially to the extent illustrated in FIG. 7. Again, it must be mentioned that the panel members actually exceed this (to the aforementioned spacing) to enable the lamp to subsequently move slightly upward to effect tab engagement. This depression in turn causes each panel member to slightly pull away at the juncture location. Provision of a J-shaped cut 83 at each of these junctures compensates for this separation without tearing of the panel's corresponding side wall (i.e., 24). As stated above, this represents a significant feature of the invention in that it enables lamp 13 to be overdriven to the extent desired.

While there have been shown and described what are at present considered the preferred embodiments of the invention, it will be obvious to those skilled in the art that various changes and modifications may remain therein without departing from the scope of the invention as defined by the appended claims.

What is claimed is:

1. A display carton for an electric lamp having a bulbous portion and a protuding end portion, said display carton comprising:

a paperboard member having a plurality of side walls hingedly connected to one another and defining a pair of opposing end portions therein:

a first panel member hingedly secured to at least one of said side walls and bent inwardly toward the interior of said paperboard member, said first panel member extending over more then half the distance between opposing side walls of said paperboard member;

a second panel member hingedly secured to at least another of said side walls and bent inwardly toward the interior of said paperboard member, said second panel member also extending over more then half the distance between opposing side walls of said paperboard member, said second panel member disposed upon said first panel member;

means forming display windows in each of the sidewalls upon which said first and said second panel members are secured;

means forming an aperture in each of said first and second panel members, each of said aperture means being aligned with the other so that when said panel members are bent inwardly, said apertures defining a common aperture for having said protruding end portion of said lamp positioned therein, said panel members forming a downwardly depressed resilient platform capable of exerting an upward force against said lamp when said protruding end portion is positioned within said aperture means, said positioning of said protruding end portion causing said resilient platform to assume said downwardly depressed orientation; and a first tab member hingedly secured to or forming part of one of said side walls and extending inwardly toward the interior of said paperboard member to engage the upper surface of said bulbous portion of said lamp, and a second tab member hingedly secured to or forming part of another of said side walls and also extending inwardly toward the interior of said paperboard member to engage an upper surface of said bulbous portion of said lamp, said panel members and said tab members combining to exert a compressive force on said lamp to securely retain said lamp within said paperboard member.

2. The display carton according to claim 1 wherein the first panel member is bent inwardly toward the interior of said paperboard member leaving an opening(s) in said one side wall(s) which serves as said display window for said lamp, and said second panel member is also bent inwardly toward the interior of said paperboard member also leaving an opening(s) in said another side wall(s) which also serves as said display window for said lamp.

3. The display carton according to claim 2 wherein the number of said side walls is eight.

4. The display carton according to claim 2 wherein said panel members are secured to or from part of at least a pair of opposite side walls of said paperboard member.

5. The display carton according to claim 2 wherein said tab members are secured to or form part of at least a pair of opposite side walls of said paperboard member.

6. The display carton according to claim 2 wherein each of said panel members is secured to or forms part of the same opposite side walls of said paperboard member as a respective one of said tab members.

7. The display carton according to claim 2 wherein said first and second panel members from a connection therebetween when so bent inwardly and aligned to form said downwardly depressed resilient platform.

8. The display carton according to claim 7 wherein one of said panel members includes a protruding tab segment and the other of said panel members includes a slot therein, said tab segment aligning with and being slidably positioned within said slot to form said connection between said panel members.

9. The display carton according to claim 2 including means therein to allow said protruding end portion of said lamp to be inserted into said common aperture defined by said inwardly bent and downwardly depressed, aligned panel members sufficiently to cause said downward depression of said panel members prior to said engagement of said bulbous portion of said lamp by said tab members without tearing said paperboard member.

10. The display carton according to claim 9 wherein said means for allowing said insertion of said lamp without said tearing said paperboard member comprises a plurality of cuts within preselected ones of said side walls of said paperboard member relative to said locations wherein said panel members are bent inwardly toward said interior of said paperboard member.

11. The display carton according to claim 1 wherein each of said tab members is adapted for being engaged through a respective one of said openings left by said inwardly bent panel members to effect said engagement with said surface of said bulbous portion of said lamp

* * * * *